US006044586A

United States Patent [19]

Wotke

[11] Patent Number: 6,044,586

[45] Date of Patent: Apr. 4, 2000

[54] RELEASEABLE TURNSTILE LOCK

[75] Inventor: Andreas Wotke, Klosterneuburg, Austria

[73] Assignee: Karl Gotschlich Maschinenbau Ges. m.b.H., Vienna, Austria

[21] Appl. No.: 09/317,060

[22] Filed: May 24, 1999

[30] Foreign Application Priority Data

May 25, 1998 [AT] Austria ..... 895/98

[51] Int. Cl.[7] ..... E06B 11/08

[52] U.S. Cl. ..... 49/47

[58] Field of Search ..... 49/43, 46, 47, 49/138

[56] References Cited

U.S. PATENT DOCUMENTS

| | | | |
|---|---|---|---|
| 1,617,918 | 2/1927 | McLoughlin | 49/47 |
| 2,144,718 | 1/1939 | Gersbach | 49/47 |
| 3,913,717 | 10/1975 | Collins | 49/46 X |
| 3,978,613 | 9/1976 | Hayward et al. | 49/47 X |
| 5,056,261 | 10/1991 | Tetherton | 49/47 |
| 5,471,795 | 12/1995 | Gallenschütz et al. | 49/47 X |

*Primary Examiner*—Jerry Redman
*Attorney, Agent, or Firm*—Collard & Roe, P.C.

[57] ABSTRACT

A releasable turnstile lock with a star-type rotating body (4) which can be driven by a motor which is controllable by a control unit, from which body project two arms (1, 2) which are substantially rigidly connected with the star-type rotating body (4) and enclose an angle with a rotational axle of the star-type rotating body (4), with one arm (1, 2) projecting substantially horizontally from the star-type rotating body (4) in a locking position and blocking a passage (9), characterized in that a position of the arms (1, 2). In order to allow an easy return to normal operation after the initiation of an alarm, it is provided that a position of the arms (1, 2) releasing the passage is provided which is controllable by the drive motor and in which the arms (1, 2) are disposed in a vertical plane extending substantially parallel to the passage.

6 Claims, 5 Drawing Sheets

RELEASEABLE TURNSTILE LOCK

BACKGROUND OF THE INVENTION

1. Field of the Invention

The invention relates to a releasable turnstile lock.

2. Description of the Prior Art

Such releasable turnstile locks are known both with vertical rotational axles as well as such which are inclined against the horizontal. In both embodiments the drive is designed in such a way that the star-type rotating body always moves over an angle of 180° at each step.

This leads to the disadvantage, however, that in such a releasable turnstile lock the passage can never be released for a period exceeding the duration of a step of the startype rotating body, which would be required during the occurrence of an emergency or a panic. It is therefore necessary in such releasable turnstile locks that the second delimitation of the passage can be respectively displaced or pivoted away in order to allow a larger number of persons to pass rapidly.

Such an arrangement is only possible, however, if the required space was provided for already during the layout of a building secured by such a turnstile lock.

In known such turnstile locks it has also been proposed to provide the arms projecting from the star-type rotating body with a joint that can be unlatched. In the event of an alarm the joint of the arm in the blocking position is unlatched, whereby the joint having an axis extending substantially horizontal and perpendicular to the longitudinal axis of the respective arm. As a result of the unlatching of the joint, the arm can suspend in a substantially downward vertical manner, with the unlatching occurring by an electromagnet or also by overpressing a catch.

This leads to the disadvantage, however, that the arm can be brought even by involuntary contact to an oscillating movement which is directed transversally to the passage and obstructs the same, e.g. by touching with wider cut clothing such as skirts. As a result, the following persons, which due to an alarm will follow at very small intervals, can be endangered to a very considerable extent, thus leading in particular to a high danger of falling.

Moreover, joints that can be locked require a considerable amount of design and production effort and it is necessary in such known turnstile locks to return manually the arms of the star-type rotating bodies again to their operational position after each initiation of an alarm.

Moreover, three-arm releasable turnstile locks are known in which the arms are mutually connected with the star-type rotating body via elastically deformable coupling elements.

Such releasable turnstile locks lead to the disadvantage that the passage cannot be freed up completely and arms can get entangled during the oscillating movement during a panic, which could lead to a serious endangerment of such persons. Moreover, such a turnstile lock requires continuous monitoring, as otherwise unauthorised passage of the turnstile lock could otherwise not be recognised.

SUMMARY OF THE INVENTION

It is the object of the present invention to avoid such disadvantages and to provide a releasable turnstile lock of the kind mentioned above which is characterized by a simple arrangement and in which an obstruction of the passage caused by a merely involuntary contact with the arms is prevented during the alarm state of the turnstile lock.

This is achieved in accordance with the invention by a twoarm turnstile lock for blocking and unblocking a passage through a passageway. The turnstile lock comprises a star-type rotating body having a rotational shaft; a drive motor rigidly connected to the rotational shaft for driving the rotating body; only two arms rigidly connected to the rotating body and projecting therefrom, the arms enclosing an angle with the rotational shaft and being arranged to assume two blocking positions wherein one of the arms projects substantially horizontally into the passageway to block the passageway; and a control unit connected to, and controlling the operation of, the drive motor. During normal operation, the rotating body is driven in a stepwise rotation between a first blocking position in which one of the arms extends substantially horizontally into the passageway and a second blocking position in which the other arm extends substantially horizontally into the passageway. During an unblocking operation, the rotating body is retained in an unblocking position in which the two arms are held in a vertical plane extending substantially parallel to the passageway to unblock the passage.

The passage can be freed up rapidly when required as a result of the possibility to bring the arms into a position releasing the passage. For this purpose it is merely required to trigger the drive in a suitable manner.

A substantially stable position of the arms in this position is ensured in the position of the star-type rotating body which opens the passage as a result of its entire moment of inertia, including that of the two arms, that of the motor and, mostly, also that of a gear interposed between the motor and the star-type rotating body.

It is also possible to connect the arms with the star-type rotating body by interposing an elastic part, so that there is a certain uncoupling of the moment of inertia from the arms on the one hand and from the startype rotating body including motor, gear and rotational axle, on the other hand. This leads to a reduction in the impulse to which a user can be subjected by the following arm when leaving the passage at a too low speed. It is sufficient, however, that the arms can oscillate by a small angular amount as a result of the interposed elastic.

The arms can be turned into the position releasing the passage by the motor when an alarm signal is present. This can be secured by a suitable triggering of the control unit. For this purpose no special installations are required, as is the case in previously known solutions with electromagnetically detachable locks of the arms. In the event of any rapid clearance of the area secured by the releasable turnstile locks, there are no delays as would otherwise be unavoidable by unlatching the arms by overpressing a catch. A substantial improvement of security in the event of an alarm is achieved by the measures proposed in accordance with the invention.

Moreover, it is easily possible by the proposed measures to return to the usual operating position from the position releasing the passage. For this purpose it is merely necessary to perform a suitable triggering of the control unit, so that the same will activate the motor in order to further rotate the star-type rotating body by 120°, as a result of which an arm will project substantially horizontally and transversally to the passage and will block the same. No manual locking of the individual turnstile arms is required, as would otherwise be the case in conventional solutions. For this reason it is also simply possible in a releasable turnstile lock in accordance with the invention to release the passage when necessary, e.g. for a handicapped person, by issuing an alarm signal to the control unit and to rapidly return to normal operation again.

The angular position of the two arms to one another can fluctuate within larger limits, with the angles of 120° and 240°, respectively, being the most preferable. In any case, however, the angular position of the arms towards one another is not critical.

It features of claim 3 it is possible to keep the cycle of the motor time substantially constant while indexing the star-type rotating body, irrespective of whether the star-type rotating body has to be swivelled about approx. 120° or by approx. 240°. This also avoids that in the case of indexing by approx. 240° the pass-through time for a user is substantially increased and therefore even more than one person can pass through the turnstile simultaneously or within a cycle time, since in the case of indexing by approx. 240° the star-type rotating body is rotated twice as quickly as in the case of indexing the same by approx. 120°.

The rotating body may be locked in at least the unblocking position freeing the passage, and this has the advantage that the passage in the position in which the star-type rotating body releases the same will also remain free when a person gets caught on one of the two arms with a clothing article. In the event of an alarm and a subsequent rapid clearance of the areas secured by the turnstile there cannot be any immediate obstructions by inadvertently entrained arms of the star-type rotating body, which obstructions represent a serious danger to falling or injury for the next following person. Thus, forces can certainly be exerted on arms in which caught clothing articles can tear without that any swivelling of the star-type rotating body occurs, which would lead to the swivelling of an arm into the clearance of the passage. This achieves a high amount of security in the event of a rapid clearing of an area secured by the turnstile.

It is possible to release the lock by interrupting the power circuit to an electrically actuatable brake. A sufficiently long buffering can be easily achieved by the battery in the event of a power failure in order to ensure a secure locking of the star-type rotating body in the position releasing the passage during the clearance of an area during the clearing time.

BRIEF DESCRIPTION OF THE DRAWING

The invention is now explained in closer detail by reference to the enclosed drawing, wherein.

DETAILED DESCRIPTION OF PREFERRED EMBODIMENTS

Figure 1:
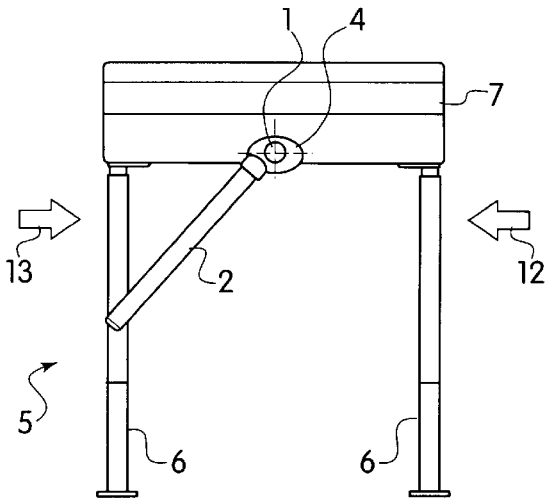
FIGS. 1 and 2 schematically show a first embodiment of a releasable turnstile lock in accordance with the invention in a first operating position transverse to the direction of passage
Figure 2:
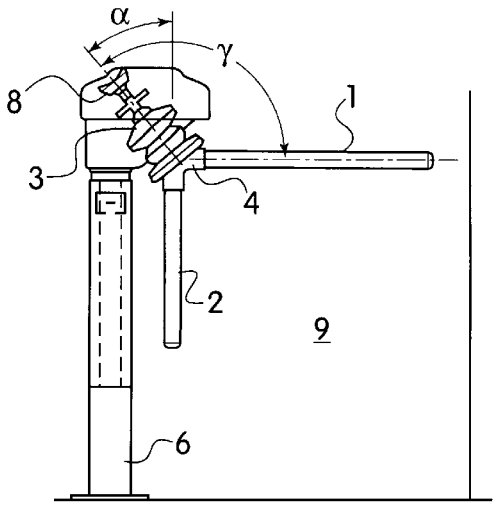
Figure 3:
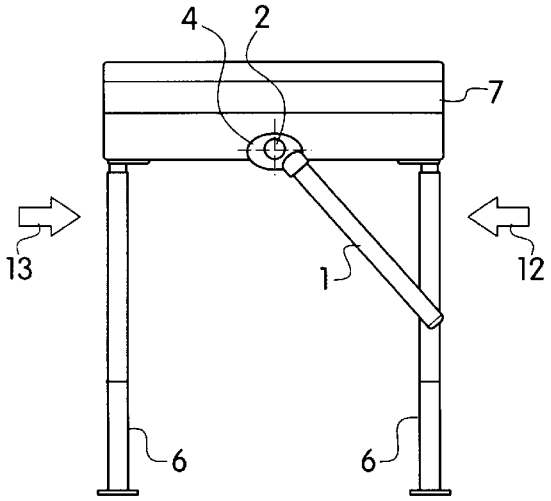
FIGS. 3 and 4 show the releasable turnstile lock in accordance with FIGS. 1 and 2 in a second operating position.
Figure 4:
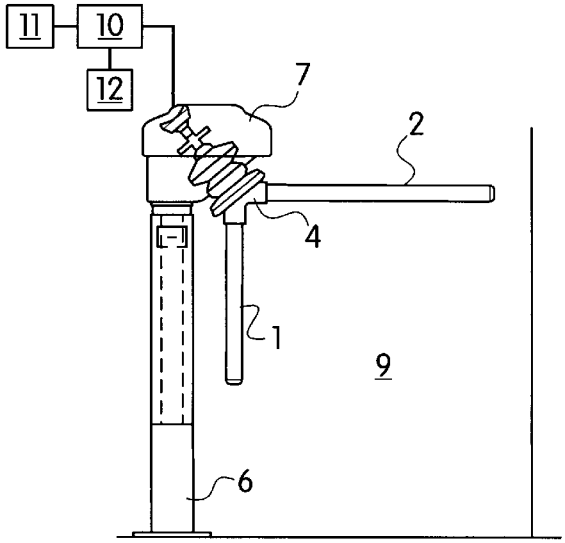
Figure 6:
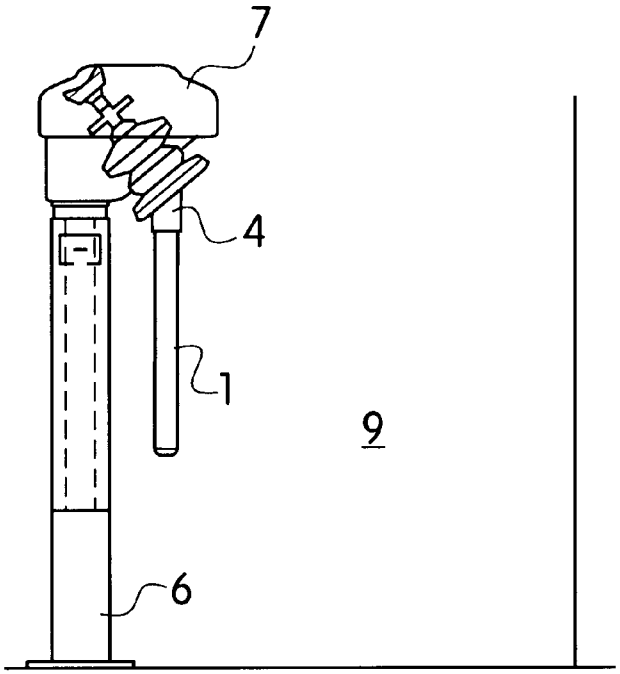
FIGS. 5 and 6 show the releasable turnstile lock in accordance with FIGS. 1 and 2 in the position releasing the passage.
Figure 5:
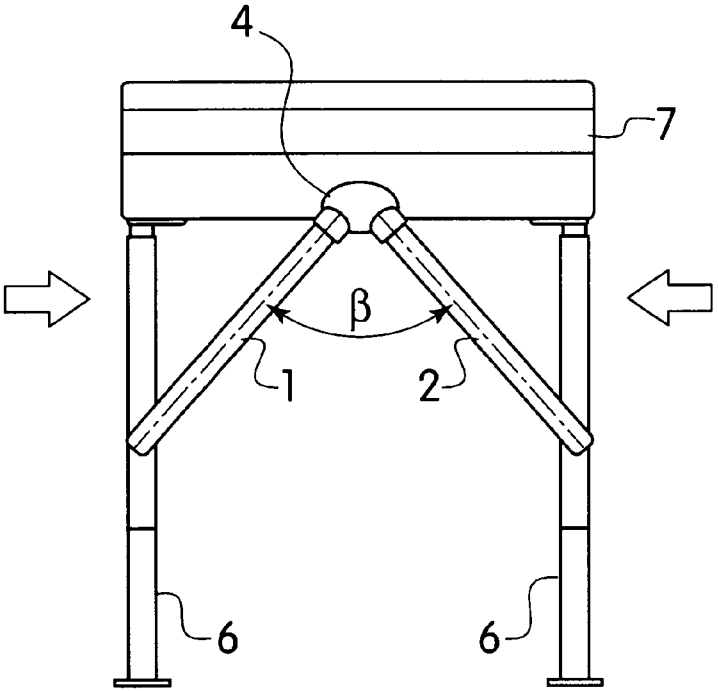
Figure 8:
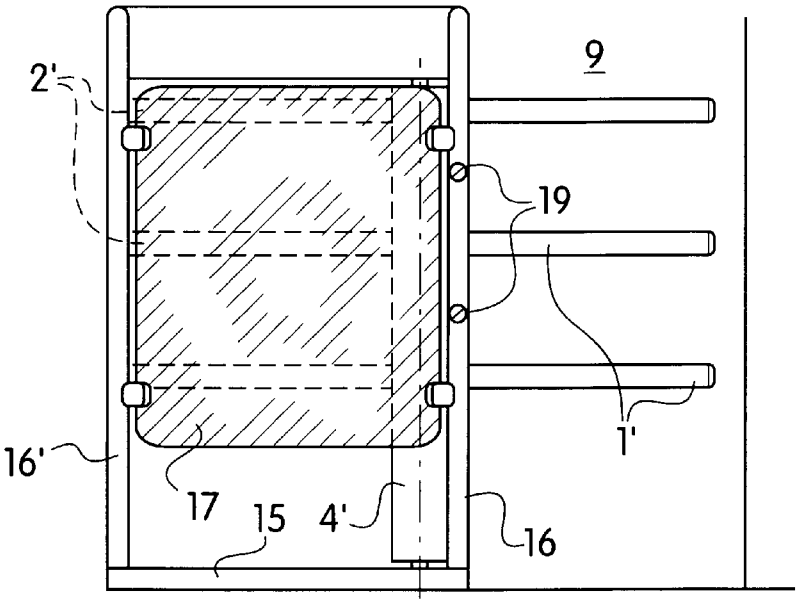
FIGS. 7 to 9 show schematic elevated, side and plan views of a second embodiment of a releasable turnstile lock in accordance with the invention in an operating position.
Figure 7:
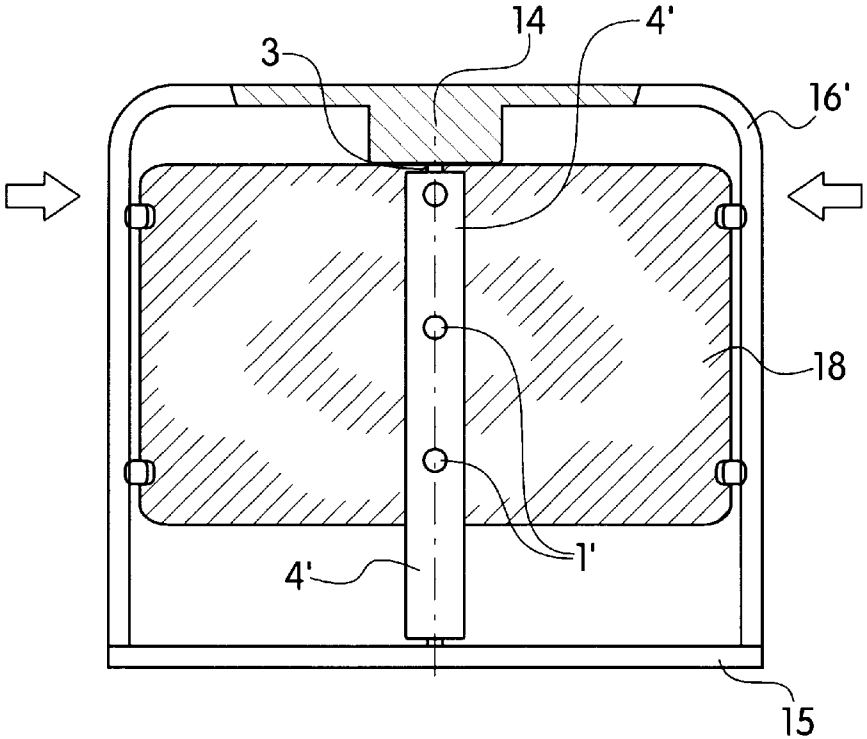

The releasable lock in accordance with FIGS. 1 to 6 is provided with a substantially U-shaped frame 5 with two pillars 6 and a cross-beam 7 in which a drive 3 is arranged, which is shown schematically in FIGS. 2, 4 and 6.

Said drive 3 is provided with a rotational axle 8 which is inclined at an angle $\alpha$ of approx. 45° against the vertical and comprises a gear (not shown) in addition to the motor. The rotational axle 8 extends in a plane perpendicular to the passage 9.

Rotational axle 8 is torsionally rigidly connected with a star-type rotating body 4, from which two arms 1, 2 project between which an angle $\beta$ of approx. 120° is enclosed and of which each encloses an angle $\gamma$ of approx. 135° with the rotational axle 8.

As a result, one of the two arms 1, 2 projects away from the star-type rotating body 4 substantially horizontal and transversely to the passage 9 and blocks the passage 9 in the two operating positions pursuant to FIGS. 1 and 2 on the one hand and FIGS. 3 and 4 on the other hand.

As is merely schematically indicated in FIG. 4, the drive 3 is connected with a control unit 10 which triggers the drive in a stepwise manner and ensures that the star-type rotating body 4 is moved forward while passing through passage 9 by an angular amount of 120° or 240°, depending on the direction of passage and the position of arms 1, 2.

Accordingly, during the passage of a person in the direction of arrow 12 the star-type rotating body must be brought from the position as illustrated in FIGS. 1 and 2 to the position as illustrated in FIGS. 3 and 4, with a rotational angle of the star-type rotating body 4 of approx. 120° being required. During the passage in the direction of arrow 13 a rotational angle of approx. 240° would be required for this purpose. The same angle would also be required in a passage in the direction of arrow 12 in order to bring the arms 1, 2 from the position as illustrated in FIGS. 3 and 4 to the position as illustrated in FIGS. 1 and 2.

The control unit 10 which is connected with an input 11 which can be formed by a card reader for example controls the drive 3 of the star-type rotating body 4 depending on the pass-through direction and the required rotational angle, which drive 3 can be operated with different speeds, e.g. speeds standing at a ratio of 1:2, and in different directions of rotation. In this way it is possible to keep substantially constant the cycle time for covering the required rotational angle. Accordingly, the drive runs with double speed when covering a rotational angle of the star-type rotating body of 240° as compared with steps for covering a rotational angle of 120°. This control depending on the rotational angle to be covered can be irrespective of the required rotational direction when the releasable turnstile lock can be passed in different directions.

In the case of releasable turnstile locks which are designed in such a way that they can only be passed in one direction, e.g. in ski-lifts, the changeover of the speed can occur after each step. For this purpose it is merely necessary to bring the star-type rotating body 4 into a specific position after an alarm, from which the changeover of the speed of the drive can be performed after each step again in a specific sequence.

The control unit 10 is further connected with a battery 12 which is used for buffering purposes in the event of any mains failure. Moreover, the battery 12 also supplies an electrically actuatable brake in the case of a mains failure which will lock the star-type rotating body 4 in the position releasing the passage. The brake (not shown) will remain in the braking position as long as it remains energised.

If after the end of the alarm state the excitation current of the brake is interrupted and the same is released as a result, the star-type rotating body 4 can be brought back to its normal operating position by a respective control pulse.

In the embodiment pursuant to FIGS. 7 to 12, two bows 16, 16' are provided which are anchored with their legs in the ground and are erected parallel with respect to one another and to the passage 9. The two bows 16, 16' are connected through a bridge element 14 in which also the vertical rotating shaft 3 is held and a drive for the same is housed.

The rotating shaft 3 is further held in a base plate 15 and torsionally rigidly connected with a star-type rotating body 4' from which three arms 1' and 2' each project.

Plates 17 are held between the two bows 16, 16' which, as seen in the pass-through directions indicated by arrows 12, 13, connect the two forward legs of the bows 16, 16' with the two rear legs of the bows 16, 16' or are held between the same and prevent any unintentional access to the rotating zone of arms 1', 2'. Moreover, a plate 18 is held between the two legs of the bow 16' which is averted from the passage 9 and is also used for securing the rotating zone of arms 1', 2'.

Blocking arms 19 project horizontally from the legs of bow 16 in the plane of bow 16 which limits the passage laterally. The arms 1', 2' of the star-type rotating body 4' can be moved through said legs.

Figure 9:
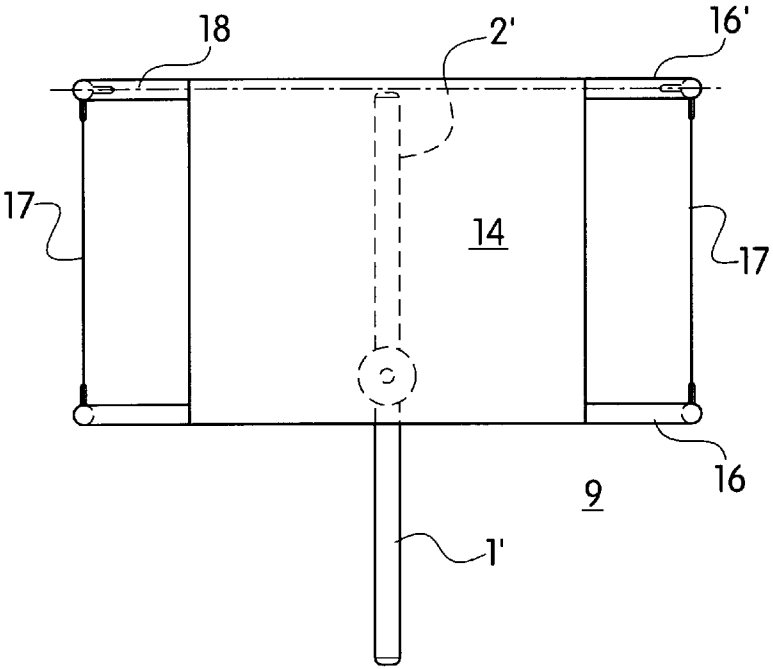
Figure 12:
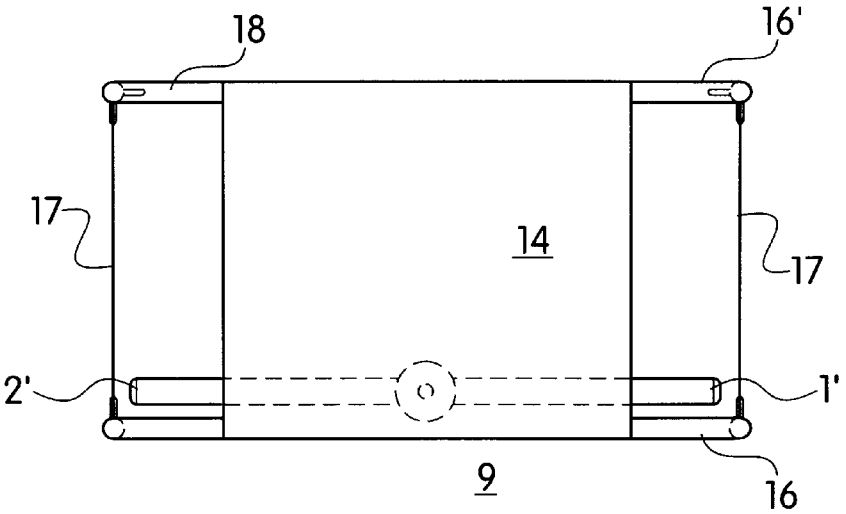

As can be seen from FIGS. 9 and 12, the rotating shaft 3 and star-type rotating body 4, as seen from the passage 9, extend behind the plane defined by bow 16.

In normal operation the drive of rotating shaft 3 arranged in the bridge element 14 causes a stepwise rotation of the star-type rotating body 4' by 180° each, with either arms 1' or arms 2' projecting into passage 9 and blocking the same.

Figure 10:
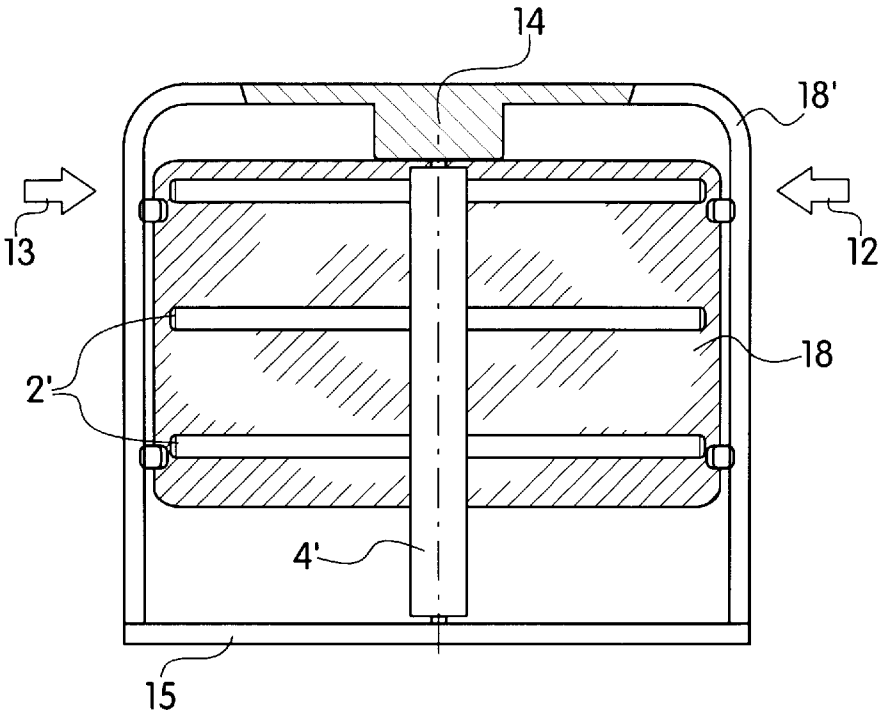
FIGS. 10 to 12 show the embodiment in accordance with FIGS. 7 to 10 in a position releasing the passage.
Figure 11:
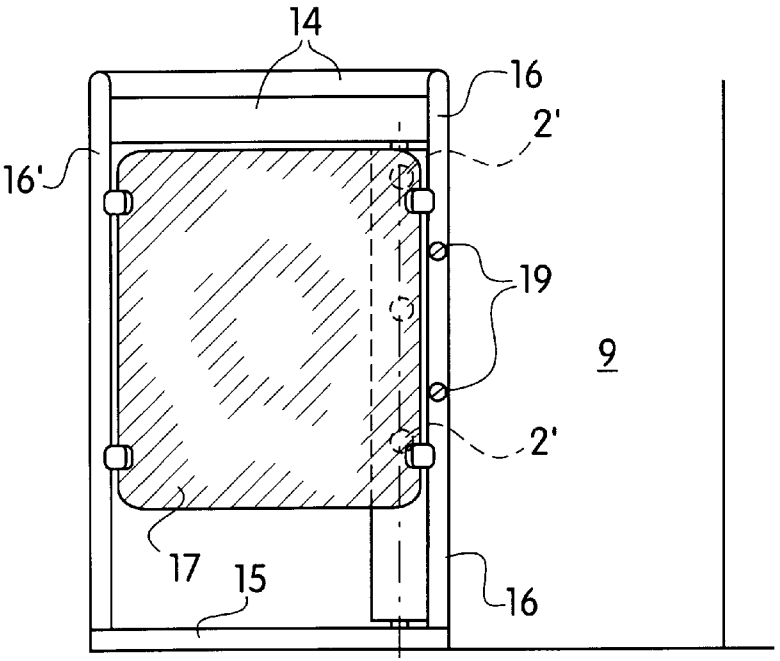

In the event of an alarm the drive (not shown in FIGS. 7 to 12) rotates the star-type rotating body 4' about an angle of 90°, so that the arms 1', 2' are brought into the position as shown in FIGS. 10 to 12. Appropriately, the star-type rotating body is braked in this position for the duration of the alarm in order to prevent any inadvertent rotation. In this respect, the friction of an optionally present gear can be sufficient or a brake is provided which for the duration of the alarm will remain in its braked position.

In the embodiment in accordance with FIGS. 7 to 10 the drive needs to be designed to merely one rotational speed. If the passage 9 is to become passable in both directions as marked with arrows 12, 13, it is necessary to provide the possibility of the reversal of the rotational direction.

The triggering of the drive of star-type rotating body 4' can be designed substantially similar to that of the embodiment pursuant to FIGS. 1 to 6. A changeover of the speed can be omitted, however.

I claim:

1. A two-arm turnstile lock for blocking and unblocking a passage through a passageway, which comprises (a) a star-type rotating body having a rotational shaft, (b) a drive motor rigidly connected to the rotational shaft for driving the rotating body, (c) only two arms rigidly connected to the rotating body and projecting therefrom, the arms (1) enclosing an angle with the rotational shaft and (2) being arranged to assume two blocking positions wherein one of the arms projects substantially horizontally into the passageway to block the passageway, and (d) a control unit connected to, and controlling the operation of, the drive motor so that, (1) during normal operation, the rotating body is driven in a stepwise rotation between a first blocking position in which one of the arms extends substantially horizontally into the passageway and a second blocking position in which the other arm extends substantially horizontally into the passageway, and (2) during an unblocking operation, the rotating body is retained in an unblocking position in which the two arms are held in a vertical plane extending substantially parallel to the passageway to unblock the passage.

2. The two-arm turnstile lock of claim 1, wherein the rotational axis is inclined by about 45° against the horizontal, the two arms enclose an angle of about 135° with the rotational axis, and the two arms enclose an angle of about 120° with each other.

3. The two-arm turnstile lock of claim 1, wherein the rotational axis is inclined by about 45° against the horizontal, the two arms enclose an angle of about 135° with the rotational axis, and the two arms enclose an angle of about 240° with each other.

4. The two-arm turnstile lock of claim 1, wherein the rotational speed of the motor is changeable.

5. The two-arm turnstile lock of claim 1, wherein the rotating body may be locked at least in the unblocking position.

6. The two-arm turnstile lock of claim 5, wherein the control unit comprises an electrically actuatable brake for locking the rotating body.

* * * * *